US008725011B2

(12) United States Patent
Yoshii et al.

(10) Patent No.: US 8,725,011 B2
(45) Date of Patent: May 13, 2014

(54) TONER TRANSPORTATION DEVICE, IMAGE FORMING APPARATUS, AND METHOD OF DETECTING THE AMOUNT OF TONER REMAINING

(75) Inventors: Tatsuhiko Yoshii, Osaka (JP); Koji Murata, Osaka (JP); Naoki Mizutani, Osaka (JP); Takeshi Fujimura, Osaka (JP); Naoki Yamane, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 191 days.

(21) Appl. No.: 13/427,454

(22) Filed: Mar. 22, 2012

(65) Prior Publication Data

US 2012/0243888 A1 Sep. 27, 2012

(30) Foreign Application Priority Data

Mar. 24, 2011 (JP) ..... 2011-066042

(51) Int. Cl.
*G03G 15/08* (2006.01)

(52) U.S. Cl.
CPC ..... *G03G 15/0831* (2013.01)
USPC ..... 399/27

(58) Field of Classification Search
CPC ..... G03G 15/0831; G03G 15/0834; G03G 2215/0685; G03G 2215/0695; G03G 2215/0697
USPC ..... 399/27, 262, 263
See application file for complete search history.

(56) References Cited

U.S. PATENT DOCUMENTS 7,653,340 B2 * 1/2010 Shida et al. ..... 399/406
2005/0265738 A1 12/2005 Ogata

FOREIGN PATENT DOCUMENTS

| | | | |
|---|---|---|---|
| JP | 10268621 A | * | 10/1998 |
| JP | 11-052699 | | 2/1999 |
| JP | 2006-251549 | | 9/2006 |
| JP | 2009-116001 | | 5/2009 |
| JP | 2010-276955 | | 12/2010 |

OTHER PUBLICATIONS

Machine Translation of JP 10-268621 A, obtained on Nov. 20, 2013.*
Japanese Office Action 2011-066042 dated Oct. 22, 2013, 3 pages.

* cited by examiner

*Primary Examiner* — David Gray
*Assistant Examiner* — Gregory H Curran
(74) *Attorney, Agent, or Firm* — K&L Gates LLP

(57) ABSTRACT

A toner transportation device includes a first toner case that contains toner; a second toner case including a main body containing toner transported from the first toner case, a second discharge port located in the main body that discharges toner, and a second transportation unit rotatably positioned in the main body, and that transports toner to the second discharge port; a second driving unit that drives the second transportation unit; a detecting unit that detects the number of rotations of the second transportation unit and outputs a rotation detection signal; and a control unit that estimates the amount of toner remaining in the first toner case based on an accumulated number of rotations represented by the rotation detection signal.

10 Claims, 12 Drawing Sheets

TONER TRANSPORTATION DEVICE, IMAGE FORMING APPARATUS, AND METHOD OF DETECTING THE AMOUNT OF TONER REMAINING

INCORPORATION BY REFERENCE

This application is based upon and claims the benefit of priority from the corresponding Japanese Patent application No. 2011-066042, filed Mar. 24, 2011, the entire contents of which is incorporated herein by reference.

BACKGROUND

The present disclosure relates to a toner transportation device that supplies toner to a developing unit, an image forming apparatus that includes the toner transportation device, and a method of detecting the amount of toner remaining.

In related art electrophotographic image forming apparatus, a developing process is performed by supplying toner from a developing unit to an electrostatic latent image formed on the surface of a photosensitive drum. The toner used in developing processes is supplied to the developing unit from the toner transportation device which includes, for example, a toner container and an intermediate hopper that contain toner.

As the developing process is repeated, the amount of toner remaining in the toner container decreases. The toner container needs to be replaced when the toner runs out. To determine when to replace the toner container, a typical image forming apparatus has a configuration for detecting or calculating the amount of toner remaining in the toner container. Examples of such a configuration include a design wherein a permeability sensor is provided to detect the change in permeability in the toner container associated with a reduction in the amount of toner, and a configuration in which an optical sensor is provided to detect the change in light transmittance in the toner container associated with a reduction in the amount of toner. There is also a design wherein the amount of toner consumption is calculated based on the number of dots in a developed image, and the amount of toner remaining in the toner container is estimated based on the calculated amount of toner consumption.

However, in the method that detects light transmittance in the toner container using an optical sensor, contamination of the toner container may cause an erroneous detection. The method that detects permeability in the toner container using a permeability sensor is not applicable to nonmagnetic toner. Moreover, in this method, variations in magnetic force may cause an erroneous detection. Estimating the amount of toner remaining in the toner container based on the number of dots in a developed image, indirectly estimates the amount of remaining toner using the number of dots. Because this tends to cause an error between the estimated amount of remaining toner and the actual amount of remaining toner, it is difficult to accurately estimate the amount of remaining toner.

SUMMARY

A toner transportation device according to an embodiment of the present disclosure is provided including a first toner case, a second toner case, a second driving unit designed for the second toner case, a detecting unit, and a control unit. The first toner case is configured to contain toner. The second toner case includes: a main body configured to contain toner transported from the first toner case; a second discharge port designed for the second toner case, located in the main body, and configured to discharge toner; and a second transportation unit designed for the second toner case, rotatably positioned in the main body, and configured to transport toner to the second discharge port. The second driving unit is configured to drive the second transportation unit. The detecting unit is configured to detect the number of rotations of the second transportation unit and output a rotation detection signal. The control unit is configured to estimate the amount of toner remaining in the first toner case based on an accumulated number of rotations represented by the rotation detection signal outputted from the detecting unit.

An image forming apparatus according to an embodiment of the present disclosure is provided including a first toner case, a second toner case, a second driving unit designed for the second toner case, a detecting unit, and a control unit. The first toner case is configured to contain toner. The second toner case includes: a main body configured to contain toner transported from the first toner case; a second discharge port designed for the second toner case, located in the main body, and configured to discharge toner; and a second transportation unit designed for the second toner case, rotatably positioned in the main body, and configured to transport toner to the second discharge port. The second driving unit is configured to drive the second transportation unit. The detecting unit is configured to detect the number of rotations of the second transportation unit and output a rotation detection signal. The control unit is configured to estimate the amount of toner remaining in the first toner case based on an accumulated number of rotations represented by the rotation detection signal outputted from the detecting unit.

A method of detecting the amount of toner remaining according to an embodiment of the present disclosure is provided comprising detecting the amount of toner remaining in a toner transportation device that includes a first toner case configured to contain toner, a second toner case connected to the first toner case, a second driving unit designed for the second toner case, and a second transportation unit designed for the second toner case and configured to transport toner by being rotated by the second driving unit. The method includes detecting the number of rotations of the second transportation unit to output a rotation detection signal, and comparing the accumulated number of rotations represented by the rotation detection signal with a predetermined threshold value to estimate the amount of toner remaining in the first toner case.

Additional features and advantages are described herein, and will be apparent from the following Detailed Description and the figures.

DETAILED DESCRIPTION

Figure 1:
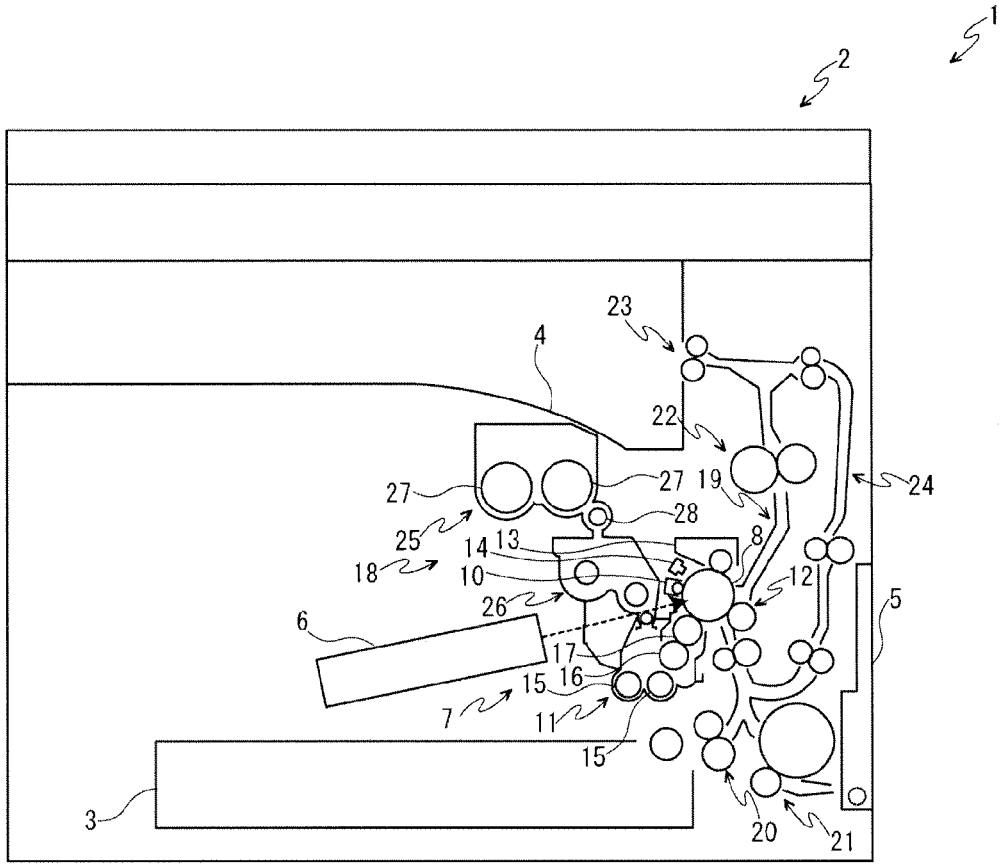
FIG. 1 is a diagram schematically illustrating a configuration of a monochrome printer according to an embodiment of the present disclosure.

An overall configuration of a monochrome printer 1 (image forming apparatus) will be described with reference to FIG. 1. FIG. 1 is a diagram schematically illustrating a configuration of a monochrome printer according to an embodiment of the present disclosure.

The monochrome printer 1 includes a box-shaped printer main body 2. A paper feed cassette 3, which contains transfer sheets, is located in the lower part of the printer main body 2. A paper output tray 4 is located at the top of the printer main body 2. An openable and closable manual feed tray 5 is located in the lower part of one side (right side in FIG. 1) of the printer main body 2.

An exposure unit 6 comprising a laser scanning unit (LSU), is located in the center of the lower part of the printer main body 2. An image forming unit 7 is located on one side (right side in FIG. 1) of the printer main body 2. A photosensitive drum 8 is rotatably located in the image forming unit 7. The photosensitive drum 8 is surrounded by a charging unit 10, a developing unit 11, a transfer unit 12, a cleaning device 13, and a charge eliminating unit 14 that are arranged in order of a transfer process.

A pair of agitating rollers 15 is located in the lower part of the developing unit 11. A magnetic roller 16 is located above the agitating rollers 15. A developing roller 17 is located above the magnetic roller 16. A toner transportation device 18 is located above the developing unit 11. The details of the toner transportation device 18 will be described hereinafter.

The transportation path 19 for transporting transfer sheets is provided on one side (right side in FIG. 1) of the printer main body 2. A paper feed unit 20 and a manual paper-feed unit 21 are positioned at an upstream end of the transportation path 19. A fixing unit 22 is located at a downstream position of the transportation path 19. A paper output port 23 is located at a downstream end of the transportation path 19. A reversing path 24 is located at one end (right end in FIG. 1) of the printer main body 2.

An image forming operation of the monochrome printer 1 having the above-described configuration will now be described.

When the monochrome printer 1 is powered on, various parameters are initialized and initial settings, including a temperature setting for the fixing unit 22, are determined. When image data and an instruction to start printing are inputted from a computer or the like connected to the monochrome printer 1, an image forming operation is performed in the following manner.

First, after the surface of the photosensitive drum 8 is charged by the charging unit 10, the photosensitive drum 8 is exposed to laser light from the exposure unit 6 based on the image data, so that an electrostatic latent image is formed on the surface of the photosensitive drum 8. Next, the developing unit 11 develops the electrostatic latent image into a toner image.

A transfer sheet fed from the paper feed cassette 3 or the manual feed tray 5 by the paper feed unit 20 or the manual paper-feed unit 21 is transported to the transfer unit 12 in synchronization with the image forming operation described above. In the transfer unit 12, the toner image on the photosensitive drum 8 is transferred onto the transfer sheet. The transfer sheet having the toner image transferred thereon is transported downstream along the transportation path 19 and enters the fixing unit 22, where the toner image is fixed to the transfer sheet. The transfer sheet having the toner image fixed thereto is ejected through the paper output port 23 to the paper output tray 4. Toner and electric charge remaining on the photosensitive drum 8 are removed by the cleaning device 13 and the charge eliminating unit 14.

Figure 2:
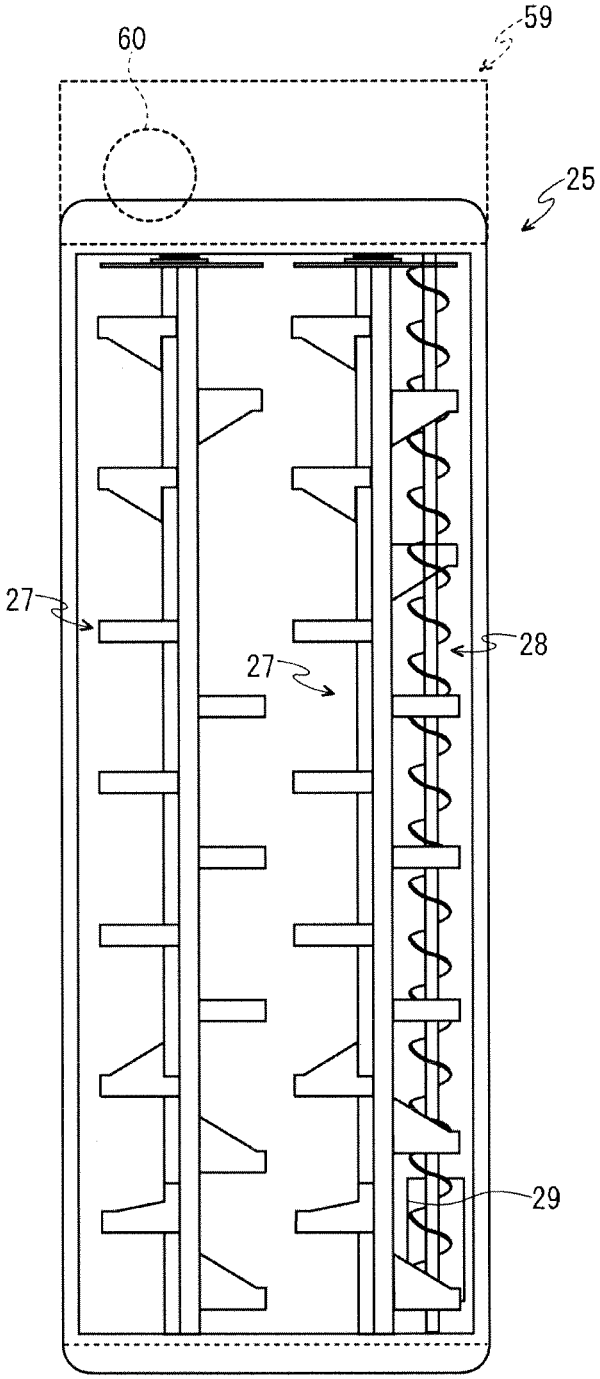
FIG. 2 is a plan view illustrating an internal structure of a toner container in the monochrome printer.
Figure 3:
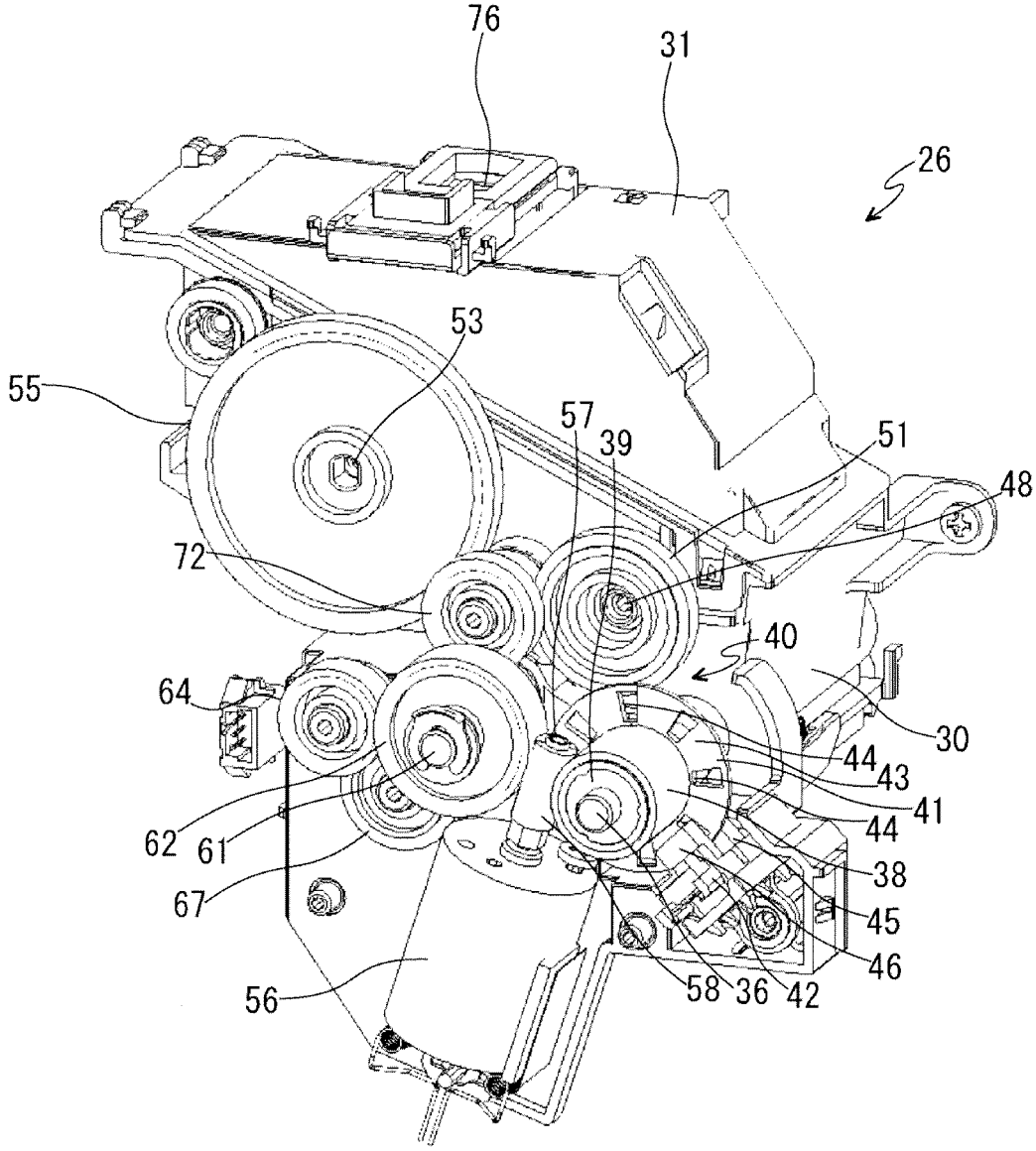
FIG. 3 is a frontal perspective view of an intermediate hopper of the monochrome printer.
Figure 4:
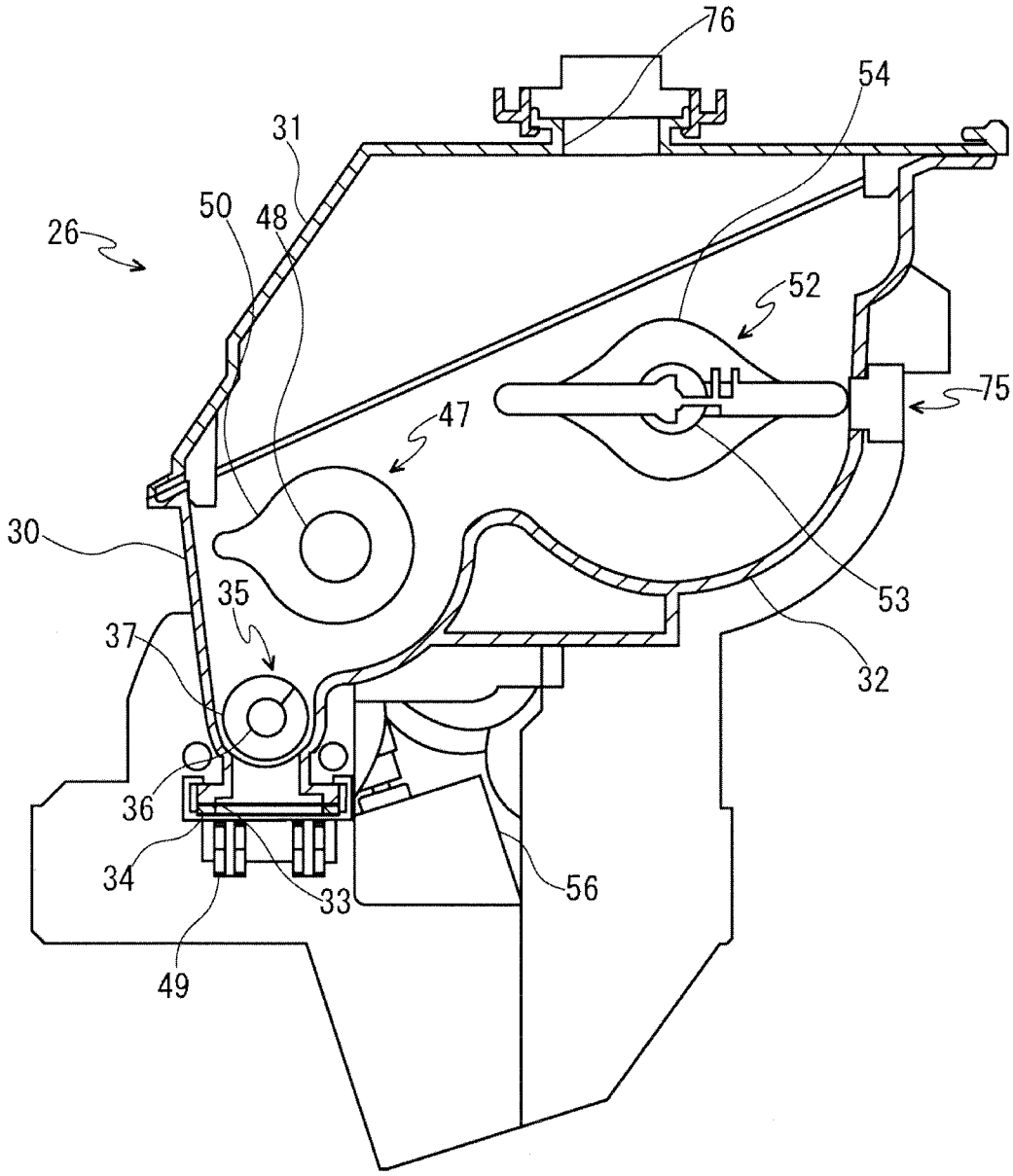
FIG. 4 is a cross-sectional back side view of the intermediate hopper.
Figure 5:
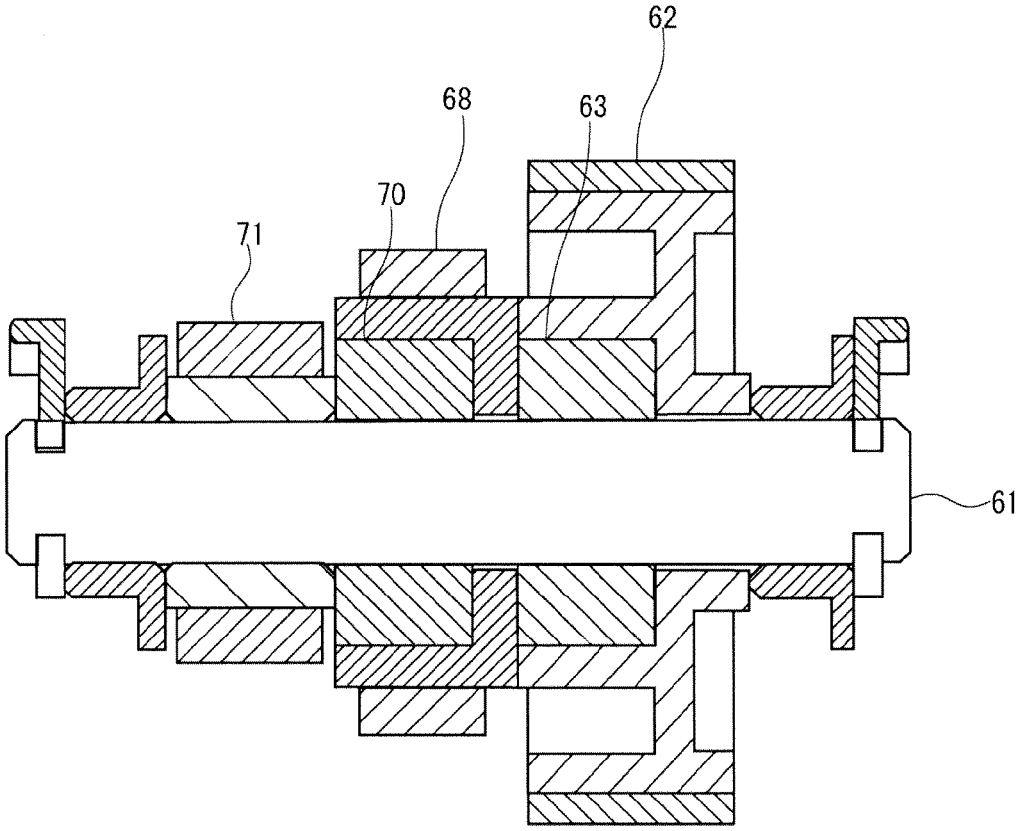
FIG. 5 is a cross-sectional view illustrating a configuration of each gear mounted on a transmission shaft in the intermediate hopper.
Figure 6:
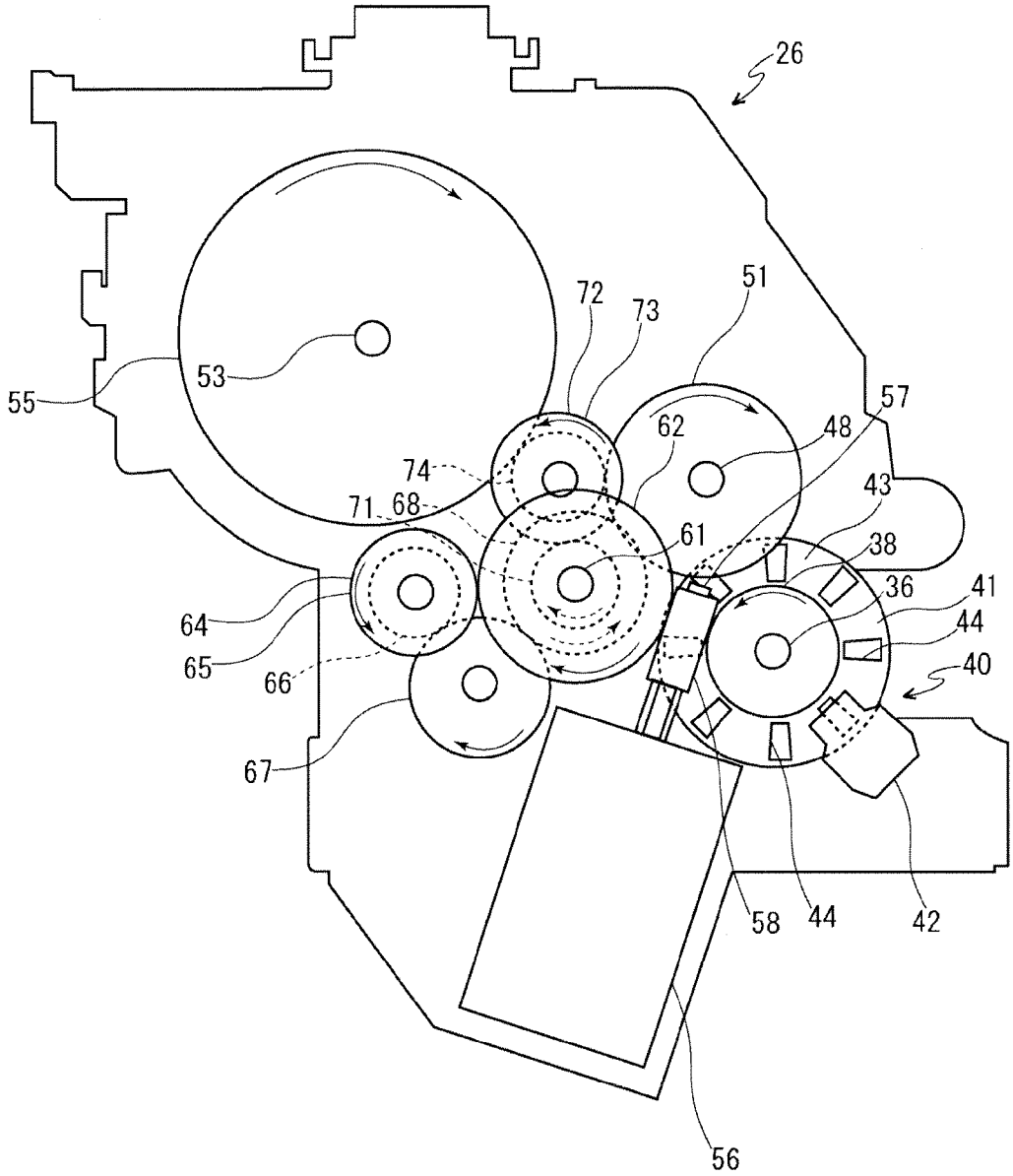
FIG. 6 is a diagram illustrating the direction of rotation of each gear of the intermediate hopper during forward rotation of a second driving motor in the intermediate hopper.
Figure 7:
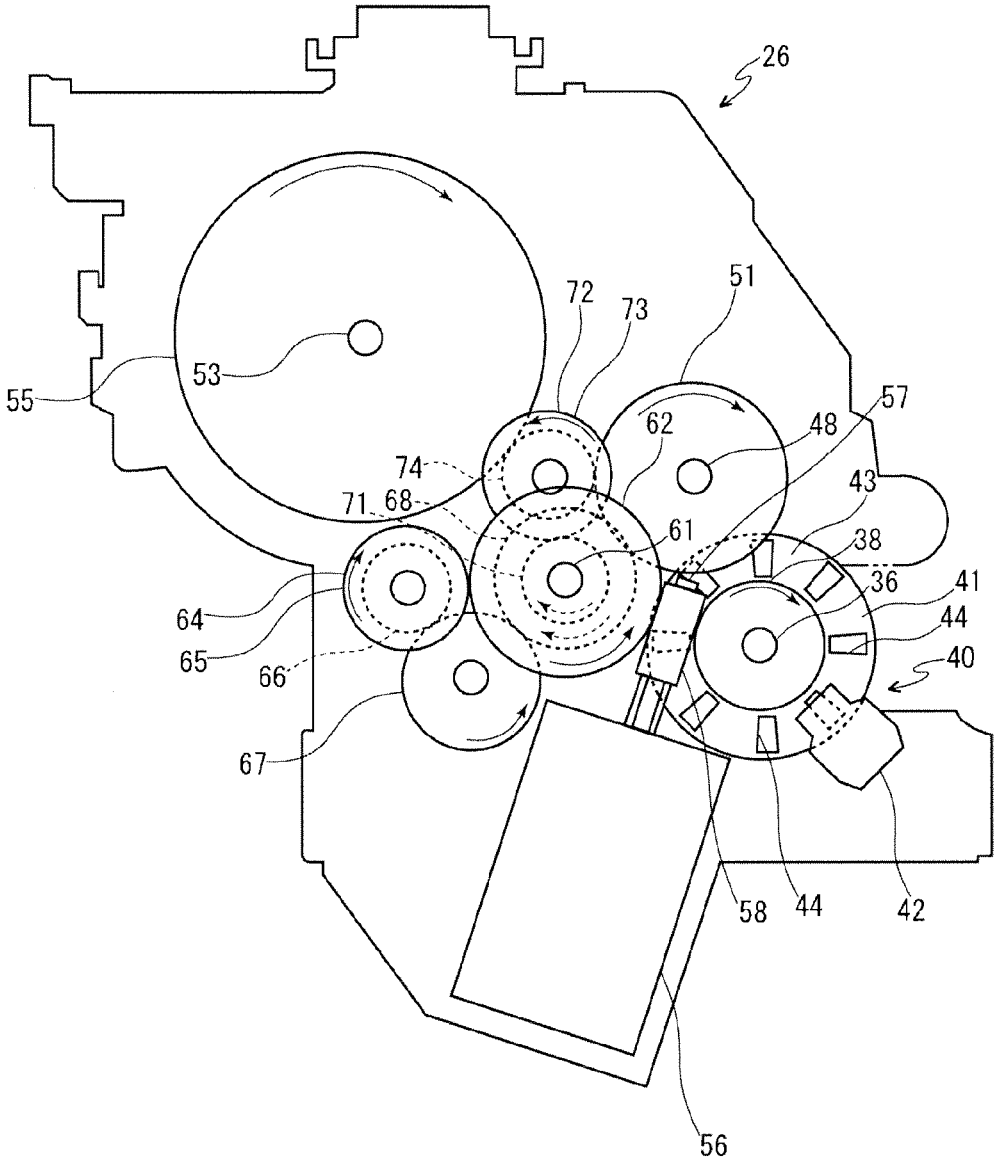
FIG. 7 is a diagram illustrating the direction of rotation of each gear of the intermediate hopper during reverse rotation of the second driving motor in the intermediate hopper.

The toner transportation device 18 will now be described with reference to FIG. 1 to FIG. 7. For convenience of description, the near side in FIG. 1 will be referred to as the front side of the toner transportation device 18. As described above, FIG. 1 is a diagram schematically illustrating a configuration of a monochrome printer according to an embodiment of the present disclosure. FIG. 2 is a plan view illustrating an internal structure of a toner container in the monochrome printer. FIG. 3 is a frontal perspective view of an intermediate hopper of the monochrome printer. FIG. 4 is a cross-sectional back side view of the intermediate hopper. FIG. 5 is a cross-sectional view illustrating a configuration of each gear mounted on a transmission shaft in the intermediate hopper. FIG. 6 is a diagram illustrating the direction of rotation of each gear of the intermediate hopper during the forward rotation of a second driving motor in the intermediate hopper. FIG. 7 is a diagram illustrating the direction of rotation of each gear of the intermediate hopper during the reverse rotation of the second driving motor in the intermediate hopper.

As illustrated in FIG. 1, the toner transportation device 18 includes a toner container 25 (first toner case) located in the upper part of the printer main body 2, and an intermediate hopper 26 (second toner case) positioned between the toner container 25 and the developing unit 11.

The toner container 25 contains toner. The toner container 25 is removably mounted on a toner-container mounting part (not shown) of the printer main body 2. The toner container 25 can be replaced when toner is depleted.

As illustrated in FIG. 2, the first toner case includes a first discharge port 29 at the right front of the bottom wall of the toner container 25. A first transportation screw 28 (first transportation unit) designed for the first toner case is rotatably positioned above the first discharge port 29. A pair of right and left first agitating paddles 27 designed for the first toner case are rotatably positioned in the lower part of the toner container 25. An integrated circuit (IC) tag 95 (see FIG. 8) is attached to the back wall of the toner container 25. The details of the IC tag 95 will be described hereinafter.

A container driving unit 59 is located behind the toner container 25 such that it can be removed from the toner container 25. A substrate 94 (see FIG. 8) is attached to the container driving unit 59 at a position facing the IC tag 95 on the toner container 25, with the toner container 25 mounted on the printer main body 2. The details of the substrate 94 will be described hereinafter.

The container driving unit 59 is provided with a first driving motor 60 (first driving unit) designed for the first toner case. The first driving motor 60 is configured to be connected via a gear unit (not shown) to the first agitating paddles 27 and the first transportation screw 28, with the toner container 25 mounted on the printer main body 2.

As illustrated in FIG. 3 and FIG. 4, the intermediate hopper 26 includes a main body 30 which is open at the top and a cover 31 which covers the top of the main body 30.

The second toner case includes a second discharge port 33 (see FIG. 4) at a right end of a bottom wall 32 of the main body 30. The interior of the main body 30 communicates with the interior of the developing unit 11 via the second discharge port 33. When the intermediate hopper 26 is not mounted on the developing unit 11, the second discharge port 33 is closed by a sliding shutter 49. In synchronization with mounting of the intermediate hopper 26 on the developing unit 11, the sliding shutter 49 slides to open the second discharge port 33. Although the sliding shutter 49 is used in an embodiment, a rotating shutter may be used in another embodiment. For example, after a lever is unlocked by mounting the intermediate hopper 26 on the developing unit 11, the rotating shutter rotates in synchronization with the user's lever operation to open the second discharge port 33. On the lower surface of the bottom wall 32 of the main body 30, toner tape 34 is placed around the second discharge port 33.

In the main body 30, a second transportation screw 35 (second transportation unit) designed for the second toner case is rotatably positioned above the second discharge port 33. The second transportation screw 35 includes a rotating shaft 36 rotatably supported by the main body 30, a spiral fin 37 concentrically disposed about the rotating shaft 36, and a transportation gear 38 (see FIG. 3 etc.) positioned at a front end of the rotating shaft 36.

As illustrated in FIG. 3, a conveyance one-way clutch 39 is located between the transportation gear 38 and the rotating shaft 36 of the second transportation screw 35. The conveyance one-way clutch 39 can be formed using a known one-way clutch structure, such as a ratchet one-way clutch or a roller one-way clutch. When the transportation gear 38 rotates in one direction (counterclockwise as viewed from the front in the present embodiment), the conveyance one-way clutch 39 causes the rotating shaft 36 of the second transportation screw 35 to rotate together with the transportation gear 38. When the transportation gear 38 rotates in the other direction (clockwise as viewed from the front in the present embodiment), the conveyance one-way clutch 39 causes the transportation gear 38 to idle with respect to the rotating shaft 36 of the second transportation screw 35.

A detecting unit 40 is located in the front part of the rotating shaft 36 of the second transportation screw 35. The detecting unit 40 includes a pulse plate 41 and a sensor 42. The pulse plate 41 is positioned behind the transportation gear 38 and formed integrally with the transportation gear 38. The sensor 42 is secured to the main body 30 at the lower right of the pulse plate 41. The pulse plate 41 has a light-shielding portion 43 in its outer region. The light-shielding portion 43 is provided with eight slits 44 that are equally spaced in the circumferential direction.

The sensor 42 is a photo-interrupter sensor (PI sensor) having a light-emitting portion 45 and a light-receiving portion 46. The light-emitting portion 45 is located behind the light-shielding portion 43 in the width direction of the pulse plate 41. The light-receiving portion 46 is located in front of the light-shielding portion 43 in the width direction of the pulse plate 41. The light-emitting portion 45 and the light-receiving portion 46 face each other with the light-shielding portion 43 interposed therebetween. During rotation of the pulse plate 41, an optical detection path extending from the light-emitting portion 45 to the light-receiving portion 46 is continuously opened and closed by the light-shielding portion 43 and the slits 44. By counting the number of times the optical detection path is opened and closed, the number of rotations of the pulse plate 41 can be detected. Since the pulse plate 41 rotates together with the rotating shaft 36 of the second transportation screw 35, the number of rotations of the second transportation screw 35 can be detected by detecting the number of rotations of the pulse plate 41. The result of this detection is used to estimate the amount of toner remaining in the intermediate hopper 26. In an embodiment, when the pulse plate 41 has eight slits 44, eight pulses are detected by the sensor 42 during one rotation of the second transportation screw 35 and the pulse plate 41.

In the main body 30, a second agitating paddle 47 (see FIG. 4) designed for the second toner case is rotatably positioned to the upper left of the second transportation screw 35. The second agitating paddle 47 has a rotating shaft 48 rotatably supported by the main body 30. An agitating blade 50 formed using a flexible film, such as a polyethylene terephthalate (PET) film or a polyester film, is secured to the outer surface of the rotating shaft 48. A first agitating gear 51 (see FIG. 3 etc.) is located at the front end of the rotating shaft 48 of the second agitating paddle 47.

A second agitating paddle 52 (see FIG. 4) designed for the second toner case is rotatably positioned to the left of the second agitating paddle 47. The second agitating paddle 52 has a rotating shaft 53 rotatably supported by the main body 30. An agitating blade 54 formed using a flexible film, such as a PET film or a polyester film, is secured to the outer surface of the rotating shaft 53. A second agitating gear 55 (see FIG. 3 etc.) is located at the front end of the rotating shaft 53 of the second agitating paddle 52.

As best illustrated in FIG. 3, at the lower front of the main body 30, a second driving motor 56 (second driving unit), designed for the second toner case, is mounted at an angle toward the upper right. In an embodiment, the second driving motor 56 is a direct current (DC) brush motor. In another embodiment, any motor, such as a DC brushless motor or a stepping motor, can be used as the second driving motor 56 instead of a DC brush motor.

The second driving motor 56 has a motor shaft 57 extending toward the upper right. A worm 58 is secured to the motor shaft 57. The transportation gear 38 engages with the right side of the worm 58. This allows the motor shaft 57 of the second driving motor 56 to be connected to the rotating shaft 36 of the second transportation screw 35, via the worm 58, the transportation gear 38, and the conveyance one-way clutch 39.

The motor shaft 57 of the second driving motor 56 is also connected to the rotating shaft 48 of the second agitating paddle 47 and to the rotating shaft 53 of the second agitating paddle 52.

This connection will now be more specifically described. A transmission shaft 61 is located to the left of the worm 58 on the motor shaft 57 of the second driving motor 56. The left side of the worm 58 engages with a first transmission gear 62 at the front end of the transmission shaft 61.

As illustrated in FIG. 5, a first one-way clutch 63 is located between the first transmission gear 62 and the transmission shaft 61. The first one-way clutch 63 can be formed using a known one-way clutch structure, such as a ratchet one-way clutch or a roller one-way clutch. When the first transmission gear 62 rotates in one direction (clockwise as viewed from the front in the present embodiment), the first one-way clutch 63 causes the transmission shaft 61 to rotate together with the first transmission gear 62. When the first transmission gear 62 rotates in the other direction (counterclockwise as viewed from the front in the present embodiment), the first one-way clutch 63 causes the first transmission gear 62 to idle with respect to the transmission shaft 61.

As illustrated in FIG. 6 and FIG. 7, the first transmission gear 62 engages with a large-diameter portion 65 of a first intermediate gear 64 located to the left of the first transmission gear 62. A small-diameter portion 66 of the first intermediate gear 64 engages with a second intermediate gear 67 positioned to the lower right of the first intermediate gear 64. The second intermediate gear 67 engages with a second transmission gear 68 located on the transmission shaft 61 at a position behind the first transmission gear 62.

As illustrated in FIG. 5, a second one-way clutch 70 is positioned between the second transmission gear 68 and the transmission shaft 61. The second one-way clutch 70 can be formed using a known one-way clutch structure, such as a ratchet one-way clutch or a roller one-way clutch. When the second transmission gear 68 rotates in one direction (clockwise as viewed from the front in the present embodiment), the second one-way clutch 70 causes the transmission shaft 61 to rotate together with the second transmission gear 68. When the second transmission gear 68 rotates in the other direction (counterclockwise as viewed from the front in the present embodiment), the second one-way clutch 70 causes the second transmission gear 68 to idle with respect to the transmission shaft 61.

As illustrated in FIG. 6 and FIG. 7, a third transmission gear 71 rotationally integral with the transmission shaft 61 is located behind the second transmission gear 68. The third transmission gear 71 engages with a large-diameter portion 73 of a third intermediate gear 72 positioned above the third transmission gear 71. The first agitating gear 51 on the rotating shaft 48 of the second agitating paddle 47 engages with the right side of a small-diameter portion 74 of the third intermediate gear 72. The second agitating gear 55 on the rotating shaft 53 of the second agitating paddle 52 engages with the left side of the small-diameter portion 74 of the third intermediate gear 72.

With the configuration described above, the motor shaft 57 of the second driving motor 56 is connected to the rotating shaft 48 of the second agitating paddle 47 and to the rotating shaft 53 of the second agitating paddle 52. In an embodiment, the reduction ratio between the second transportation screw 35 and the second agitating paddle 52 is set to 1/9. Therefore, during one rotation of the second agitating paddle 52, the second transportation screw 35 rotates nine times. This means that during one rotation of the second agitating paddle 52, 8 (the number of pulses per rotation of the second transportation screw 35)×9=72 pulses are detected by the sensor 42 of the detecting unit 40.

As illustrated in FIG. 4, the main body 30 is provided with a toner level sensor 75 that detects the amount of toner. The toner level sensor 75 is located to the left of the second agitating paddle 52. In an embodiment, a piezoelectric sensor including a piezoelectric element is used as the toner level sensor 75. In another embodiment, a different type of sensor, such as an optical sensor or a permeability sensor, can be used as the toner level sensor 75 instead of a piezoelectric sensor.

The cover 31 that covers the top of the main body 30 is ultrasonically welded to the main body 30 and is provided with an inlet 76 located in the central part in the right-left direction. Toner transported from the toner container 25 is introduced through the inlet 76 into the intermediate hopper 26.

Figure 8:
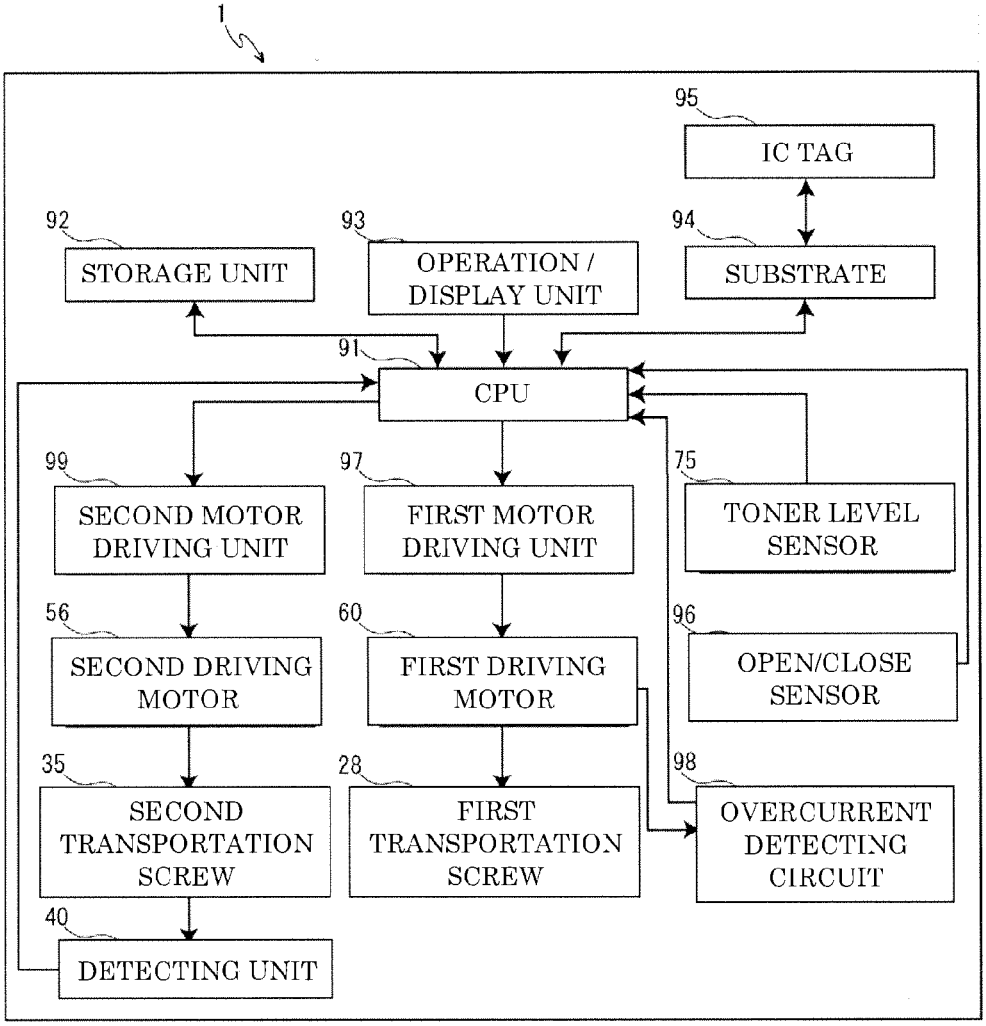
FIG. 8 is a block diagram illustrating a configuration of the monochrome printer.

A control system of the monochrome printer 1 will now be described with reference to FIG. 8. FIG. 8 is a block diagram illustrating a configuration of a monochrome printer according to an embodiment of the present disclosure.

The monochrome printer 1 includes a central processing unit (CPU) 91 (control unit). The CPU 91 is connected to a storage unit 92 which includes memory devices, such as a read-only memory (ROM) and a random-access memory (RAM). Using control programs and control data stored in the storage unit 92, the CPU 91 controls each part of the monochrome printer 1.

The CPU 91 is connected to an operation/display unit 93 included in the printer main body 2. The operation/display unit 93 includes operation keys, such as a start key, a stop/clear key, a power key, a numeric keypad, and a touch panel. When the user operates an operation key, the corresponding operation instruction is outputted to the CPU 91. In response to signals outputted from the CPU 91, various kinds of information, such as error messages and the amount of remaining toner, are displayed on the operation/display unit 93.

The CPU 91 is connected to the substrate 94 (radio-frequency identification (RFID) board) attached to the container driving unit 59. The substrate 94 performs radio communication, in the following manner, with the IC tag 95 (RFID tag) attached to the toner container 25 at a position facing the substrate 94.

The IC tag 95 includes a nonvolatile memory. The memory stores information about the toner container 25, such as model number, date of manufacture, serial number, usage history, and toner color. In response to a signal from the CPU 91, the substrate 94 reads information stored in the memory of the IC tag 95 and outputs the read information to the CPU 91. Based on the information relating to the toner container 25 read by the substrate 94, the CPU 91 makes various determinations and, as necessary, causes the operation/display unit 93 to display a determination result. For example, the CPU 91 determines whether the toner container 25 is an authorized product. The substrate 94 is capable also of writing various kinds of information to the IC tag 95. As described above, the substrate 94 serves as a reader/writer for the IC tag 95.

When the toner container 25 is removed from the printer main body 2, information about the toner container 25 is deleted from the CPU 91, but retained in the nonvolatile memory of the IC tag 95. When the same toner container 25 is again mounted on the printer main body 2, information about the toner container 25, retained in the memory of the IC tag 95, is read by the substrate 94 and outputted to the CPU 91. Information about the toner container 25 is then restored.

The CPU 91 is connected to the toner level sensor 75. When the toner level sensor 75 is switched on or off depending on the amount of toner in the intermediate hopper 26, the toner level sensor 75 outputs a signal to the CPU 91.

The CPU 91 is connected to an open/close sensor 96. When a front cover (not shown) of the printer main body 2 is opened or closed, the open/close sensor 96 detects this and outputs an open/close detection signal to the CPU 91.

The CPU 91 is connected to a first motor driving unit 97 designed for the first toner case. Based on an instruction signal from the CPU 91, current flows from the first motor driving unit 97 to the first driving motor 60 to cause the first driving motor 60 to rotate. The first motor driving unit 97 can comprise, for example, a known motor driving circuit which includes a transistor and a resistor.

The CPU 91 is connected to an overcurrent detecting circuit 98, which is connected to the first driving motor 60. If a current that flows through the first driving motor 60 (hereinafter referred to as the "driving current") exceeds (or is greater than or equal to) a threshold value (e.g., 0.3 A or 0.9 A), the overcurrent detecting circuit 98 transmits an overcurrent detection signal to the CPU 91. The overcurrent detecting circuit 98 comprises, for example, a known circuit which includes a resistor for detection of driving current and a comparator for comparison between a threshold value and a current value detected by the resistor. A threshold value for the driving current described above is determined, for example, based on the capacity of the toner container 25, and is stored in the storage unit 92, the memory of the IC tag 95, or the like.

The CPU 91 is connected to a second motor driving unit 99 designed for the second toner case. Based on a driving instruction signal from the CPU 91, current flows from the second motor driving unit 99 to the second driving motor 56 to cause the second driving motor 56 to rotate. The second motor driving unit 99 comprises, for example, a known motor driving circuit which includes a transistor and a resistor.

The CPU 91 is connected to the detecting unit 40. A rotation detection signal representing the number of rotations of the second transportation screw 35 (hereinafter simply referred to as the "rotation detection signal") is detected by the detecting unit 40 and outputted from the detecting unit 40 to the CPU 91. The CPU 91 controls the detecting unit 40 such that when the transportation gear 38 and the pulse plate 41 rotate in the other direction, the detecting unit 40 does not detect the number of rotations of the second transportation screw 35, except during retry control (described below).

The situation where, for example, during normal printing in a printer configured as described above, both the supply of toner from the intermediate hopper 26 to the developing unit 11 and the agitation of toner in the intermediate hopper 26 are performed at the same time will now be described.

First, the CPU 91 transmits a driving instruction signal (for forward rotation) to the second motor driving unit 99 to cause the motor shaft 57 of the second driving motor 56 to rotate forward (counterclockwise in the present embodiment). The rotation of the motor shaft 57 is transmitted via the worm 58 to the transportation gear 38 and causes the transportation gear 38 to rotate counterclockwise. In response thereto, the conveyance one-way clutch 39 causes the rotating shaft 36 of the second transportation screw 35 to rotate together with the transportation gear 38. Thus, the second transportation screw 35 rotates counterclockwise to transport toner in the intermediate hopper 26 to the developing unit 11.

When the motor shaft 57 of the second driving motor 56 is rotated forward as described above, the rotation is transmitted via the worm 58 to the first transmission gear 62 and causes the first transmission gear 62 to rotate clockwise. In response to this, the first one-way clutch 63 causes the transmission shaft 61 to rotate together with the cover film 62, so that the transmission shaft 61 and the third transmission gear 71 rotate clockwise. This causes a counterclockwise rotation of the third intermediate gear 72, whose large-diameter portion 73 engages with the third transmission gear 71, and causes a clockwise rotation of the first agitating gear 51 and the second agitating gear 55, which engage with the small-diameter portion 74 of the third intermediate gear 72. In response to this, the second agitating paddle 47 and the second agitating paddle 52 rotate clockwise. Thus, toner in the intermediate hopper 26 is transported toward the second transportation screw 35 while being agitated.

When, as described above, the first transmission gear 62 rotates clockwise, the first intermediate gear 64, whose large-diameter portion 65 engages with the first transmission gear 62, rotates counterclockwise. This causes a clockwise rotation of the second intermediate gear 67, which engages with the small-diameter portion 66 of the first intermediate gear 64, and causes a counterclockwise rotation of the second transmission gear 68, which engages with the second intermediate gear 67. When the second transmission gear 68 rotates counterclockwise, the second one-way clutch 70 causes the second transmission gear 68 to idle with respect to the transmission shaft 61. Therefore, no rotation is transmitted from the second transmission gear 68 to the transmission shaft 61.

Next, the situation where toner in the intermediate hopper 26 is agitated without being supplied from the intermediate hopper 26 to the developing unit 11 will be described.

First, the CPU 91 transmits a driving instruction signal (for reverse rotation) to the second motor driving unit 99, and allows current to flow from the second motor driving unit 99 to the second driving motor 56 causing the motor shaft 57 of the second driving motor 56 to rotate in the reverse direction (clockwise in the present embodiment). The rotation of the motor shaft 57 is transmitted via the worm 58 to the transportation gear 38 and causes the transportation gear 38 to rotate clockwise. When the transportation gear 38 rotates clockwise, the conveyance one-way clutch 39 causes the transportation gear 38 to idle with respect to the rotating shaft 36 of the second transportation screw 35. Therefore, no rotation is transmitted from the transportation gear 38 to the second transportation screw 35. Thus, since the second transportation screw 35 does not rotate, toner is not supplied from the intermediate hopper 26 to the developing unit 11.

When, as described above, the motor shaft 57 of the second driving motor 56 is rotated in the reverse direction, the rotation is transmitted via the worm 58 to the first transmission gear 62 and causes the first transmission gear 62 to rotate counterclockwise. When the first transmission gear 62 rotates counterclockwise, the first one-way clutch 63 causes the first transmission gear 62 to idle with respect to the transmission shaft 61. Therefore, no rotation is transmitted from the first transmission gear 62 to the transmission shaft 61.

When, as described above, the first transmission gear 62 rotates counterclockwise, the first intermediate gear 64, whose large-diameter portion 65 engages with the first transmission gear 62, rotates clockwise. This causes a counterclockwise rotation of the second intermediate gear 67, which engages with the small-diameter portion 66 of the first intermediate gear 64, and causes a clockwise rotation of the second transmission gear 68, which engages with the second intermediate gear 67. In response thereto, the second one-way clutch 70 causes the transmission shaft 61 to rotate together with the second transmission gear 68, so that the transmission shaft 61 and the third transmission gear 71 rotate clockwise. This causes a counterclockwise rotation of the third intermediate gear 72, whose large-diameter portion 73 engages with the third transmission gear 71, and causes a clockwise rotation of the first agitating gear 51 and the second agitating gear 55, which engage with the small-diameter portion 74 of the third intermediate gear 72. In response thereto, the second agitating paddle 47 and the second agitating paddle 52 rotate clockwise to agitate toner in the intermediate hopper 26.

Figure 9:
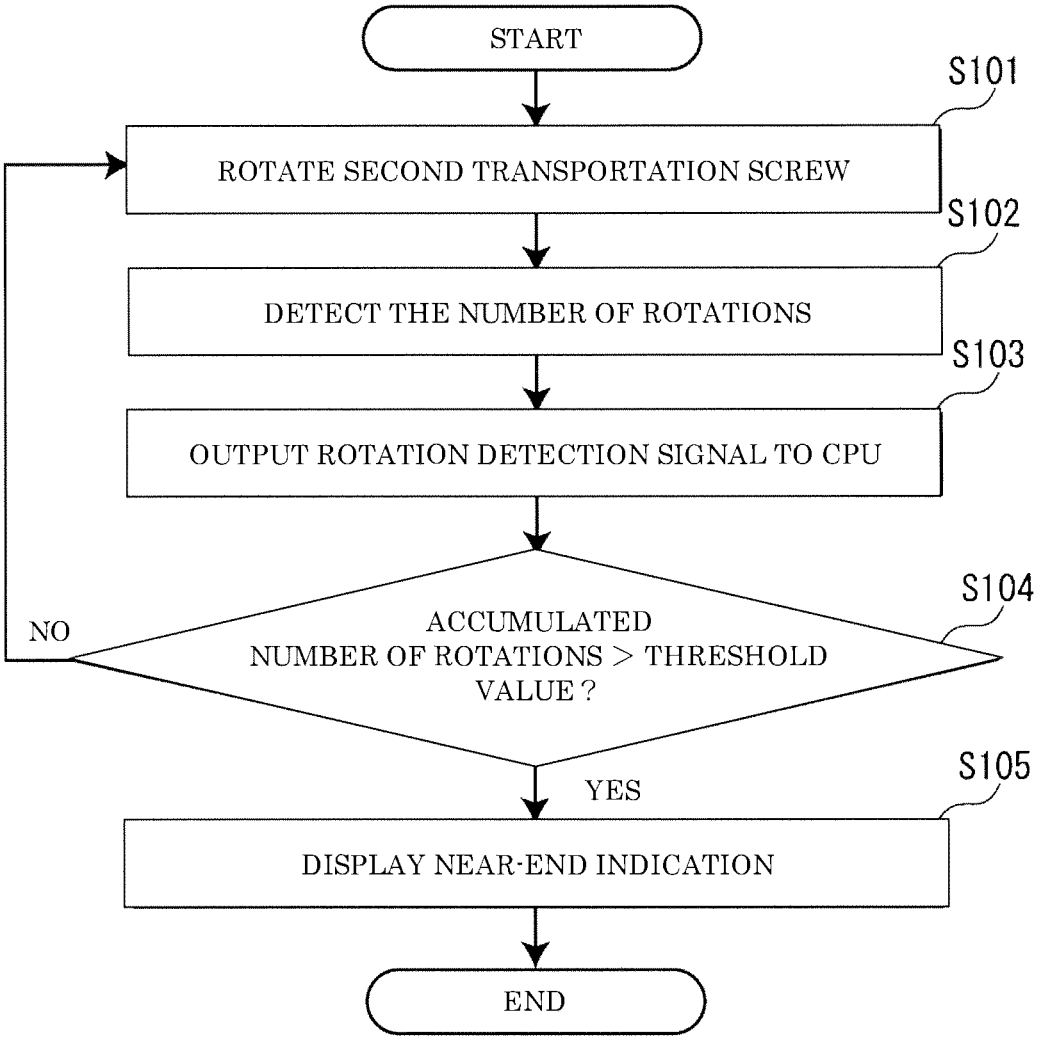
FIG. 9 is a flowchart illustrating process for estimating the amount of toner remaining using a detecting unit in the monochrome printer.

A method in which the CPU 91 estimates the amount of toner remaining in the toner container 25 with reference to FIG. 9 will now be described. FIG. 9 is a flowchart that illustrates a process performed in a monochrome printer to estimate the amount of toner remaining according to an embodiment of the present disclosure.

When the supply of toner from the toner container 25 to the developing unit 11 is started, the rotation of the second driving motor 56 is transmitted to the second transportation screw 35 causing the second transportation screw 35 to rotate (step S101). In synchronization with the rotation of the second transportation screw 35, the pulse plate 41 rotationally integral with the rotating shaft 36 of the second transportation screw 35 also rotates. As the pulse plate 41 rotates, an optical detection path extending from the light-emitting portion 45 to the light-receiving portion 46 is opened and closed by the light-shielding portion 43 and the slits 44. The sensor 42 detects this opening and closing, so that the detecting unit 40 detects the number of rotations of the second transportation screw 35 (step S102). In an embodiment, as described above, one rotation of the second transportation screw 35 corresponds to eight pulses. This means that the sensor 42 detects a pulse every ⅛ rotation of the second transportation screw 35.

When detecting the number of rotations of the second transportation screw 35, the detecting unit 40 outputs a rotation detection signal to the CPU 91 (step S103). Based on the number of rotations represented by the rotation detection signal from the detecting unit 40, the CPU 91 estimates the amount of toner remaining in the toner container 25.

The situation where toner in the toner container 25 reaches a near-end state when, for example, the second transportation screw 35 rotates 40000 times in the toner container 25 which contains 2 kg of toner will now be described.

In an embodiment, as described above, one rotation of the second transportation screw 35 corresponds to eight pulses. This means that 40000 rotations of the second transportation screw 35 correspond to 320000 pulses. For example, the numerical value "320000" is stored as a threshold value in the memory of the IC tag 95, the storage unit 92, or the like. When a rotation detection signal is outputted from the detecting unit 40, the CPU 91 compares the accumulated number of rotations represented by the rotation detection signal with the threshold value to determine whether the accumulated number of rotations exceeds the threshold value (step S104). If the CPU 91 determines that the accumulated number of rotations does not exceed the threshold value (NO in step S104), the CPU 91 estimates that a sufficient amount of toner remains in the toner container 25. Then, step S101 to step S104 are repeated.

On the other hand, if the CPU 91 determines that the accumulated number of rotations represented by the rotation detection signal exceeds the threshold value (YES in step S104), the CPU 91 estimates that only a small amount of toner remains in the toner container 25. The CPU 91 then outputs the determination result to the operation/display unit 93. This causes the operation/display unit 93 to display a message (near-end indication), such as "TONER LOW", which notifies the user that only a small amount of toner remains in the toner container 25 (step S105). Thus, the user is prompted to prepare for replacement of the toner container 25.

In an embodiment, where the detecting unit 40 for detecting the number of rotations of the second transportation screw 35 is positioned in the toner transportation device 18, the CPU 91 can estimate the amount of toner remaining in the toner container 25 without being affected, for example, by variations in magnetic force or contamination of the toner container 25. Therefore, the probability of the occurrence of an erroneous detection can be reduced to a level lower than that for the situation where permeability or light transmittance in the toner container 25 is detected using a permeability sensor or an optical sensor. Moreover, since the detecting unit 40 can be used regardless of whether the toner is magnetic or non-magnetic, the applicability of the toner transportation device 18 can be broadened. Since the estimation is based on the number of rotations of the second transportation screw 35, the amount of toner remaining in the toner container 25 can be estimated more accurately than for the situation where it is estimated based on the number of dots in a developed image. When the configuration which detects the number of rotations of the second transportation screw 35 is adopted, the reliability of rotation detection may be greater than that for the situation with the configuration which detects the duration of rotation of the second transportation screw 35.

In an embodiment, where the number of rotations of the second transportation screw 35 is detected, the amount of toner supplied to the developing unit 11 can be detected at a position close to the developing unit 11. This allows a more accurate estimation of the amount of toner remaining in the toner container 25. Since the intermediate hopper 26 includes the detecting unit 40, there is no need to place the detecting unit 40 in the toner container 25. This can simplify the configuration of the toner container which typically requires frequent replacement. Additionally, it is possible to detect the number of rotations of the second transportation screw 35 using a known toner container.

The detecting unit 40 comprises only the pulse plate 41 and the sensor 42. With this simple configuration, the number of rotations of the second transportation screw 35 can be reliably detected. As compared to the situation where the sensor light from the light-emitting portion 45 passes through the toner container 25 to reach the light-receiving portion 46, the light-emitting portion 45 and the light-receiving portion 46 can be brought closer to each other. It is thus possible to further reduce the probability of the occurrence of an erroneous detection.

Figure 10:
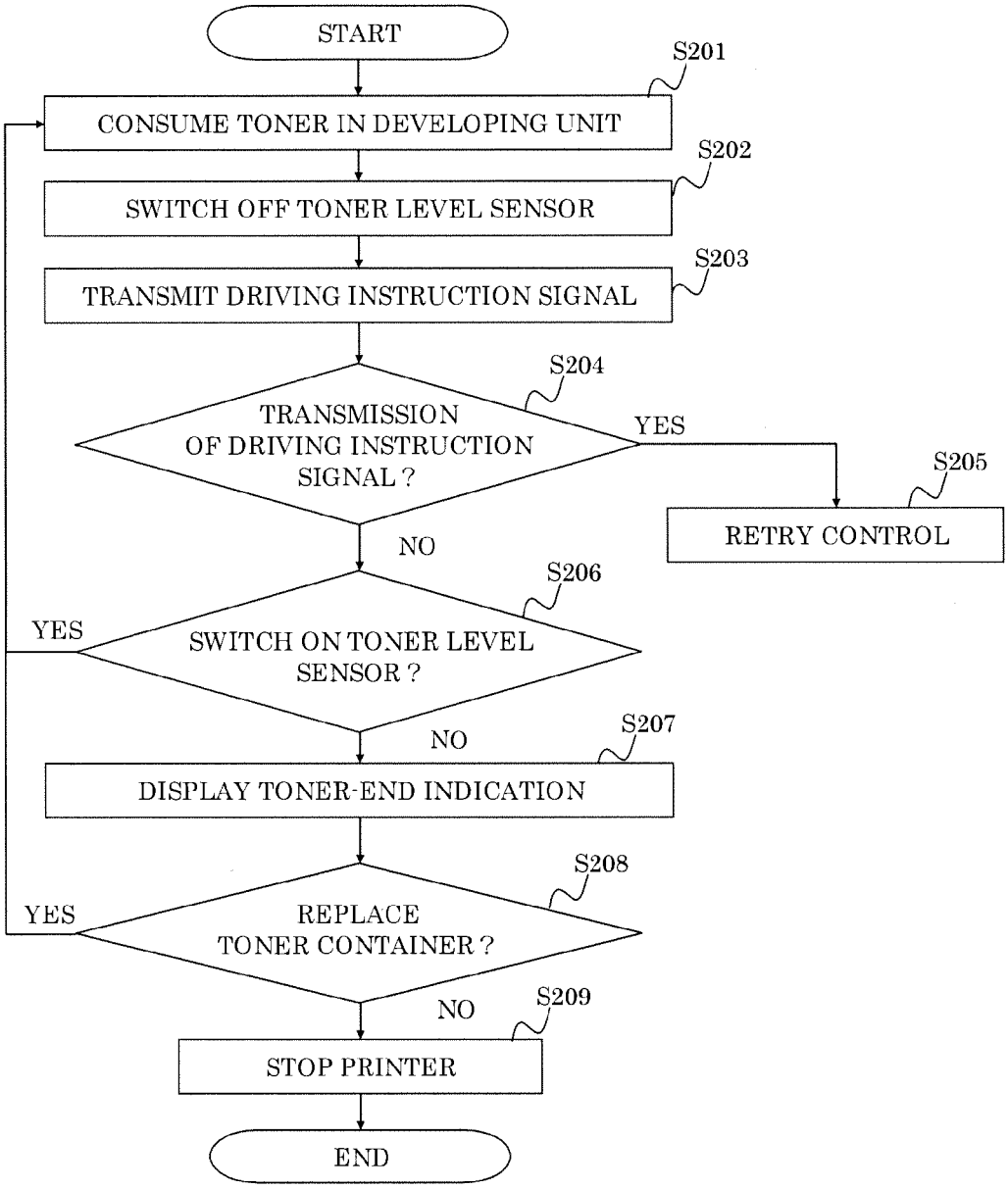
FIG. 10 is a flowchart illustrating a toner supply control process for controlling supply of toner to the intermediate hopper in the monochrome printer.

A method in which the CPU 91 controls supply of toner to the intermediate hopper 26 will be described with reference to FIG. 10. FIG. 10 is a flowchart illustrating a toner supply control process for controlling the supply of toner to an intermediate hopper in a monochrome printer according to an embodiment of the present disclosure.

As toner is consumed in the developing unit 11 in the image forming process described above (step S201), the amount of toner in the intermediate hopper 26 decreases and the toner level sensor 75 is switched from on to off (step S202). When the toner level sensor 75 is switched off, the CPU 91 determines that the intermediate hopper 26 is not filled with toner. The CPU 91 then transmits a driving instruction signal to the first motor driving unit 97 (step S203).

If the CPU 91 receives an overcurrent detection signal from the overcurrent detecting circuit 98 within a predetermined time (e.g., 200 ms) after the transmission of the driving instruction signal (YES in step S204), the CPU 91 determines that the toner container 25 is in an overloaded state (where toner is clumped in the toner container 25) and performs a retry control to end the overloaded state (step S205). In the retry control, for example, in response to the driving instruction signal from the CPU 91 to the first motor driving unit 97, the first driving motor 60 repeatedly causes the first agitating paddles 27 to rotate forward and backward.

If the CPU 91 does not receive an overcurrent detection signal from the overcurrent detecting circuit 98 within a predetermined time after the transmission of the driving instruction signal (NO in step S204), the CPU 91 monitors the on/off state of the toner level sensor 75. If the toner level sensor 75 is switched on within a predetermined time (e.g., 40 seconds) (YES in step S206), the CPU 91 determines that toner is properly supplied from the toner container 25 to the intermediate hopper 26 in response to the driving instruction signal. In this situation, the process returns to step S201 where toner is consumed in the developing unit 11, and steps S201 to S204 and step S206 are repeated.

If the toner level sensor 75 is not switched on within a predetermined time (NO in step S206), the CPU 91 determines that the toner container 25 is empty. In this situation, the CPU 91 transmits a driving stop signal to the first motor driving unit 97 to stop the first driving motor 60. At the same time, the CPU 91 outputs the determination result to the operation/display unit 93 to cause the operation/display unit 93 to display a toner-end indication, such as "TONER EMPTY", "OUT OF TONER", or "REPLACE TONER" (step S207). Thus, the user is prompted to replace the toner container 25.

When the user replaces the toner container 25, pursuant to the toner-end indication (YES in step S208), the open/close sensor 96 detects the opening and closing of the front cover (not shown) of the printer main body 2 associated with this replacement, and outputs an open/close detection signal to the CPU 91. Upon receipt of the open/close detection signal from the open/close sensor 96, the CPU 91 resets the toner-end indication on the operation/display unit 93. The CPU 91 then transmits a driving instruction signal to the first motor driving unit 97 to supply toner from the toner container 25 to the intermediate hopper 26. When the toner level sensor 75 is switched from off to on by the supply of toner, the CPU 91 determines that toner is properly supplied from the toner container 25 to the intermediate hopper 26. In this situation, the process returns to step S201 where toner is consumed in the developing unit 11, and steps S201 to S204 and step S206 are repeated.

If the toner container 25 is not replaced, even after consumption of a predetermined amount of toner (e.g., 1 kg), the CPU 91 determines that the toner container 25 is in a toner-empty state and stops the monochrome printer 1 (step S209).

In an embodiment, where the detecting unit 40 is used in combination with the toner level sensor 75, it is possible to more accurately detect whether the toner container 25 is empty.

Figure 11:
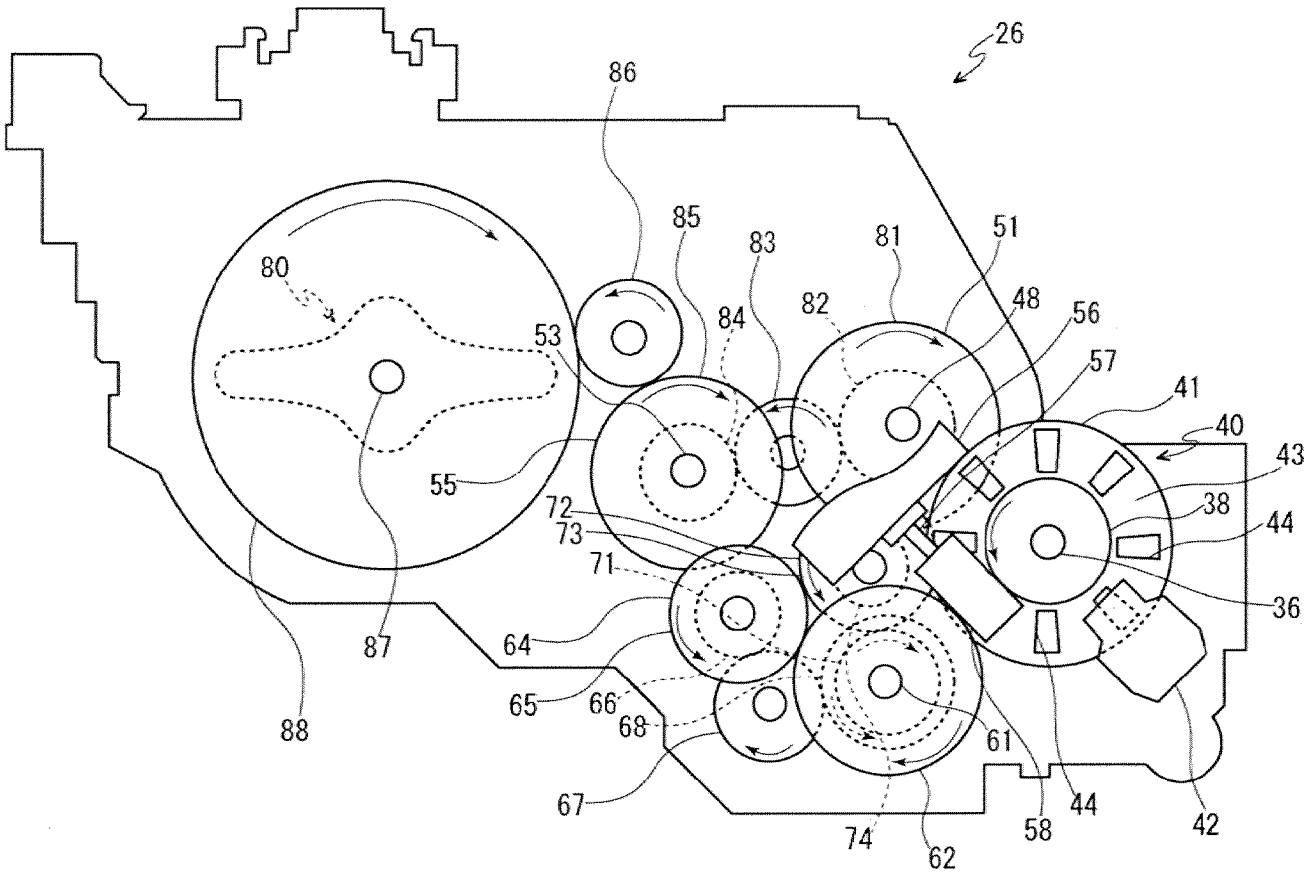
FIG. 11 is a diagram illustrating an intermediate hopper according to another embodiment.

As described above, the second agitating paddles 47 and 52 are used in an embodiment. As illustrated in FIG. 11, if the intermediate hopper 26 is horizontally longer than that of the present embodiment, a second agitating paddle 80 designed for the second toner case can be used as well as the second agitating paddles 47 and 52. In this situation, for example, the small-diameter portion 74 of the third intermediate gear 72 may engage with a large-diameter portion 81 of the first agitating gear 51, a small-diameter portion 82 of the first agitating gear 51 may engage with a small-diameter portion 84 of the second agitating gear 55 via a fourth intermediate gear 83, and a large-diameter portion 85 of the second agitating gear 55 may engage with a third agitating gear 88 on a rotating shaft 87 of the second agitating paddle 80 via a fifth intermediate gear 86. With this configuration, the second agitating paddles 47, 52, and 80 can rotate in the same direction. As described above, the number and arrangement of the second agitating paddles can be appropriately changed depending on the size and shape of the intermediate hopper 26.

Although the second driving motor 56 is positioned at an angle toward the upper right in an embodiment, the second driving motor 56 may be positioned at an angle toward the lower right in another embodiment, as illustrated in FIG. 11. In still another embodiment, the second driving motor 56 may be positioned either horizontally or vertically. Thus, the position of the second driving motor 56 can be appropriately changed depending on the size and shape of the intermediate hopper 26.

Figure 12:
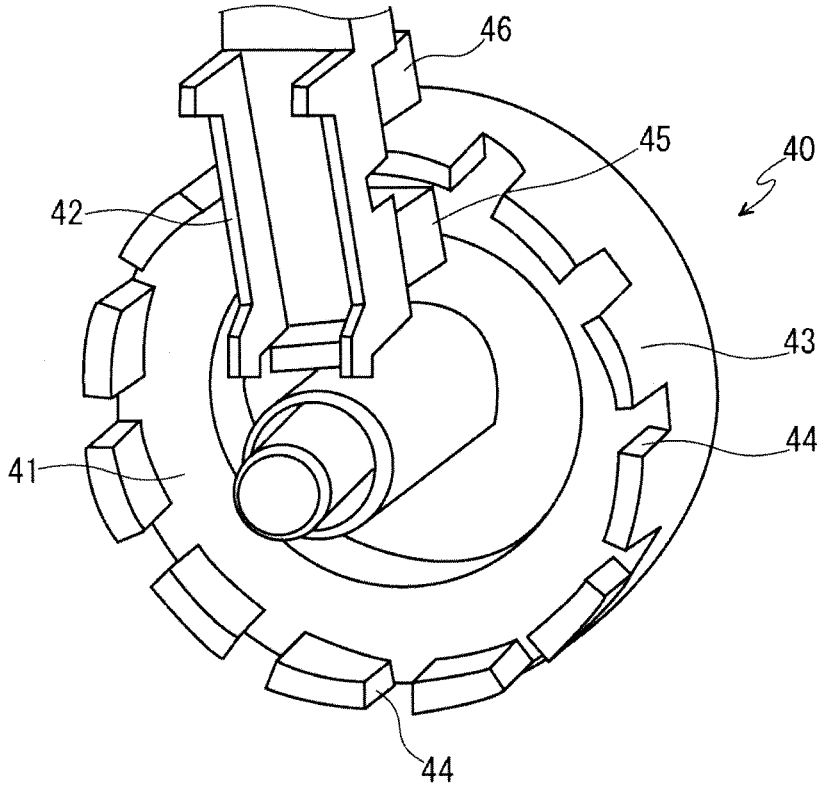
FIG. 12 is a perspective view of a detecting unit according to another embodiment.

In an embodiment, the pulse plate 41 has the light-shielding portion 43 in its outer region, and the light-emitting portion 45 and the light-receiving portion 46 of the sensor 42 are located on the back and front sides of the light-shielding portion 43 in the width direction of the pulse plate 41. In another embodiment, as illustrated in FIG. 12, the pulse plate 41 may be provided with a flange-like light-shielding portion 43 along its outer edge, and the light-emitting portion 45 and the light-receiving portion 46 may be located inside and outside the light-shielding portion 43 in the radial direction of the pulse plate 41. Thus, the shape of the pulse plate 41 and the configuration of the sensor 42 can be appropriately changed depending on the layout of the product.

Although the pulse plate 41 is provided with eight slits 44 in an embodiment, the pulse plate 41 may be provided with twelve slits 44 in another embodiment, as illustrated in FIG. 12. Thus, the number of the slits 44 can be appropriately changed depending on the required accuracy of detection and the reduction ratio of gears that connect the second transportation screw 35 and the pulse plate 41.

When the CPU 91 determines that the toner container 25 is empty, the CPU 91 causes the operation/display unit 93 to display a toner-end indication in an embodiment. In another embodiment, the CPU 91 may cause the operation/display unit 93 to display, as well as the toner-end indication described above, a message indicating that printing on a specified number of sheets is possible with toner remaining in the intermediate hopper 26.

In an embodiment, a near-end indication is displayed based on the accumulated number of rotations represented by a rotation detection signal. In another embodiment, the amount of toner remaining in the toner container 25 can be estimated based on the ratio of the accumulated number of rotations represented by a rotation detection signal to a threshold value. For example, assume that, as in the present embodiment, "320000" is stored, in a storage unit, as a threshold value for the number of rotations represented by a rotation detection signal which corresponds to a near-end state of toner. In this situation, if the accumulated number of rotations represented by a rotation detection signal is "80000", "160000", or "240000", the CPU 91 can estimate that the amount of toner consumption has reached ¼, ½, or ¾ of that in the near-end state, and cause the operation/display unit 93 to display 75%, 50%, or 25% as the amount of toner remaining that can be consumed before the near-end state is reached.

Alternatively, a threshold value for the number of rotations represented by a rotation detection signal which corresponds to each stage of the amount of toner remaining in the toner container 25 may be stored in the storage unit 92, the memory of the IC tag 95, or the like. In this situation, the CPU 91 transmits a signal to the operation/display unit 93 every time a threshold value for each stage is reached. This enables the operation/display unit 93 to display the amount of remaining toner in a stepwise manner. For example, as in the present embodiment, if "320000" is the number of rotations represented by a rotation detection signal which corresponds to a near-end state of toner, the threshold values "80000", "160000", "240000", and "320000" are stored in a storage unit. Thus, until the near-end state is reached, the amount of toner remaining can be displayed in four levels corresponding to these threshold values.

Although the pulse plate 41 is coaxial with the second transportation screw 35 in an embodiment, the pulse plate 41 may be located on an axis different from that of the second transportation screw 35 in another embodiment. Although the detecting unit 40 including the pulse plate 41 and the sensor 42 is used in an embodiment, a magnetic rotary encoder, a brush rotary encoder, or the like may be used as the detecting unit 40 in another embodiment.

In an embodiment, a counterclockwise rotation of the motor shaft 57 of the second driving motor 56 is defined as a forward rotation of the second driving motor 56. However, the definition of the forward and reverse rotations of the second driving motor 56 is made for convenience. That is, a clockwise rotation of the second driving motor 56 may be defined as a forward rotation of the second driving motor 56.

In an embodiment, the direction of counterclockwise rotation of the transportation gear 38, as viewed from the front, is defined as "one direction" of rotation of the transportation gear 38, and the direction of clockwise rotation of the transportation gear 38, as viewed from the front, is defined as "the other direction" of rotation of the transportation gear 38. In another embodiment, the direction of clockwise rotation of the transportation gear 38, as viewed from the front, may be defined as "one direction" of rotation of the transportation gear 38, and the direction of counterclockwise rotation of the transportation gear 38, as viewed from the front, may be defined as "the other direction" of rotation of the transportation gear 38.

In an embodiment, the direction of clockwise rotation of the agitating gears 51 and 55, as viewed from the front, is defined as "one direction" of rotation of the agitating gears 51 and 55, and the direction of counterclockwise rotation of the agitating gears 51 and 55, as viewed from the front, is defined as "the other direction" of rotation of the agitating gears 51 and 55. In another embodiment, the direction of counterclockwise rotation of the agitating gears 51 and 55, as viewed from the front, may be defined as "one direction" of rotation of the agitating gears 51 and 55, and the direction of clockwise rotation of the agitating gears 51 and 55, as viewed from the front, may be defined as "the other direction" of rotation of the agitating gears 51 and 55.

Although screw-like members are used as the transportation units for the first and second toner cases in an embodiment, roller-like members may be used as transportation units in another embodiment. Although paddle-like members are used as agitating units for the first and second toner cases in an embodiment, screw-like members may be used as agitating units in another embodiment.

Although the present disclosure is applied to a monochrome printer 1 in an embodiment, the present disclosure may be applied to other image forming apparatuses, such as color printers, copiers, digital multifunction peripherals, and facsimiles in other embodiments.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A toner transportation device comprising:

a first toner case that contains toner;

a second toner case including a main body that contains toner transported from the first toner case, a second discharge port located in the main body, and designed to discharge toner, and a second transportation unit rotatably positioned in the main body, and that transports toner to the second discharge port;

a second driving unit for the second toner case, and that drives the second transportation unit;

a detecting unit that detects the number of rotations of the second transportation unit and outputs a rotation detection signal;

a control unit that estimates the amount of toner remaining in the first toner case based on an accumulated number of rotations represented by the rotation detection signal outputted from the detecting unit;

a toner level sensor that detects the amount of toner in the main body;

a first discharge port located in the first toner case, and that discharges toner;

a first transportation unit rotatably positioned in the first toner case, and that transports the toner to the first discharge port; and a first driving unit that drives the first transportation unit, wherein when the toner level sensor is switched from on to off, the control unit transmits a driving instruction signal for driving the first driving unit, and if the toner level sensor is not switched from off to on within a predetermined time after the transmission of the driving instruction signal, the control unit determines that the first toner case is empty.

2. The toner transportation device according to claim 1, comprising a storage unit connected to the control unit and that stores, as a threshold value, the accumulated number of rotations represented by the rotation detection signal outputted when the amount of toner remaining in the first toner case reaches a near-end state, wherein when the rotation detection signal is outputted from the detecting unit, the control unit compares the accumulated number of rotations represented by the rotation detection signal with the threshold value stored in the storage unit and if the accumulated number of rotations exceeds the threshold value, the control unit estimates that a small amount of toner remains in the first toner case.

3. The toner transportation device according to claim 2, comprising an operation/display unit connected to the control unit, wherein when estimating that a small amount of toner remains in the first toner case, the control unit causes the operation/display unit to display a near-end indication.

4. The toner transportation device according to claim 1, comprising an operation/display unit connected to the control unit, wherein when it is determined that the first toner case is empty, the control unit causes the operation/display unit to display a toner-end indication.

5. The toner transportation device according to claim 1, wherein the detecting unit includes a pulse plate having a light-shielding portion comprising a plurality of slits arranged in a circumferential direction, the pulse plate rotating in synchronization with the rotation of the second transportation unit, and a sensor having a light-emitting portion and a light-receiving portion facing each other, with the light-shielding portion of the pulse plate interposed therebetween.

6. An image forming apparatus comprising:

a first toner case that contains toner;

a second toner case including a main body that contains toner transported from the first toner case, a second discharge port located in the main body, and that discharges the toner, and a second transportation unit rotatably positioned in the main body, and that transports the toner to the second discharge port;

a second driving unit that drives the second transportation unit;

a detecting unit that detects the number of rotations of the second transportation unit and outputs a rotation detection signal;

a control unit that estimates the amount of toner remaining in the first toner case based on an accumulated number of rotations represented by the rotation detection signal outputted from the detecting unit;

a toner level sensor that detects the amount of toner in the main body;

a first discharge port located in the first toner case, and that discharges toner;

a first transportation unit rotatably positioned in the first toner case, and that transports the toner to the first discharge port; and a first driving unit that drives the first transportation unit, wherein when the toner level sensor is switched from on to off, the control unit transmits a driving instruction signal for driving the first driving unit, and if the toner level sensor is not switched from off to on within a predetermined time after the transmission of the driving instruction signal, the control unit determines that the first toner case is empty.

7. The image forming apparatus according to claim 6, comprising a storage unit connected to the control unit that stores, as a threshold value, the accumulated number of rotations represented by the rotation detection signal outputted when the amount of toner remaining in the first toner case reaches a near-end state, wherein when the rotation detection signal is outputted from the detecting unit, the control unit compares the accumulated number of rotations represented by the rotation detection signal with the threshold value stored in the storage unit and if the accumulated number of rotations exceeds the threshold value, the control unit estimates that a small amount of toner remains in the first toner case.

8. The image forming apparatus according to claim 7, comprising an operation/display unit connected to the control unit, wherein when estimating that only a small amount of toner remains in the first toner case, the control unit causes the operation/display unit to display a near-end indication.

9. The image forming apparatus according to claim 6, comprising an operation/display unit connected to the control unit, wherein when it is determined that the first toner case is empty, the control unit causes the operation/display unit to display a toner-end indication.

10. The image forming apparatus according to claim 6, wherein the detecting unit includes a pulse plate having a light-shielding portion comprising a plurality of slits arranged in a circumferential direction, the pulse plate rotating in synchronization with the rotation of the second transportation unit, and a sensor having a light-emitting portion and a light-receiving portion facing each other, with the light-shielding portion of the pulse plate interposed therebetween.

* * * * *